US006121537A

United States Patent [19]

Pawar et al.

[11] Patent Number: 6,121,537

[45] Date of Patent: Sep. 19, 2000

[54] GUITAR PICKUP SYSTEM FOR SELECTING FROM MULTIPLE GIBSON AND FENDER TONALITIES

[75] Inventors: Jay C. Pawar; Jeffrey R. Johnston, both of Willoughby, Ohio

[73] Assignee: Pawar Guitars, Ltd., Willoughby, Ohio

[21] Appl. No.: 09/314,702

[22] Filed: May 19, 1999

[51] Int. Cl.[7] ..... G10H 3/18

[52] U.S. Cl. ..... 84/728

[58] Field of Search ..... 84/726–728

[56] References Cited

U.S. PATENT DOCUMENTS

| | | | |
|---|---|---|---|
| 3,915,048 | 10/1975 | Stich | 84/728 |
| 4,151,776 | 5/1979 | Stich . | |
| 4,222,301 | 9/1980 | Valdez . | |
| 5,136,918 | 8/1992 | Riboloff . | |
| 5,311,806 | 5/1994 | Riboloff . | |
| 5,763,808 | 6/1998 | Thomson | 84/728 |
| 5,898,121 | 4/1999 | Riboloff | 84/728 |

*Primary Examiner*—Stanley J. Witkowski
*Attorney, Agent, or Firm*—Fay, Sharpe, Fagan, Minnich & McKee

[57] ABSTRACT

An electric guitar pickup system is provided to generate a plurality of selectable desired Gibson and Fender tonality sounds from a single guitar. The pickup system includes a bridge pickup unit, a neck pickup unit, and a multiple position tonality select switch for selectively connecting the bridge pickup unit and the neck pickup unit in a plurality of desired pickup combinations, thereby selecting from a plurality of desired Fender and Gibson tonality signals. The bridge pickup unit includes a dual coil flat humbucker pickup to produce Gibson tonalities and further includes a dual coil bridge stacked humbucker pickup to produce Fender tonalities. The neck pickup unit similarly includes a dual coil flat humbucker pickup together with a dual coil neck stacked humbucker pickup to produce both Gibson and Fender tonalities.

30 Claims, 15 Drawing Sheets

GUITAR PICKUP SYSTEM FOR SELECTING FROM MULTIPLE GIBSON AND FENDER TONALITIES

BACKGROUND OF THE INVENTION

The present invention is directed toward the art of electric guitar pickups. More particularly, the invention to an electric guitar pickup system that enables a plurality of popular and well recognized tonalities, particularly Gibson and Fender tonalities and tone blends, to be played by musicians on a single guitar selectively using simple switches and pickup units disposed on the guitar body at well known locations that are familiar to electric guitarists.

The invention is especially well suited for use in electric guitars and will be described with particular reference thereto. However, the invention is capable of broader application and can be used in any musical or other instrument that uses magnetic coupling means disposed adjacent vibrating string members to generate energy or music.

It is well known in the musical arts that electric guitars can be categorized into two basic groups based upon the quality and range of sounds that they produce. A first broad class of electric guitars generate "Gibson" tonalities. A second class generates "Fender" tonalities.

The Gibson tonality, such as exemplified in the Les Paul guitar, is obtained from either or both of two dual coil hum-canceling pickups such as shown in FIG. 8 and referred herein collectively as a "dual coil flat humbucker pickup". In that configuration, the pole pieces are disposed in a relative side-by-side relationship and are associated with electrical coils that are counter-wound in order to cancel 60 Hz, cycle hum caused by stray electrical signals, radios, UV lights, and bad electrical grounding. Qualitatively, dual coil flat humbucker pickups, or Gibson type pickups, typically generate darker and louder tones relative to simple basic single coil pickup units. The darker tone sound can be attributed in part to the increased sensing range of the spaced apart rows of magnetic interaction zones between the pickup pole pieces and the vibrating wires. The louder sound is attributable to the pair of output coils.

The Fender tonality, such as exemplified in the Stratocaster or Telecaster guitars is obtained from selected combinations of single coil-type pickups. The Fender-type pickup arrangement is illustrated at FIG. 9 and is commonly referred to in the art as a "single coil pickup".

A modern innovation of the Fender single coil pickup has been to stack two coils on end to gain the hum canceling benefits of the Gibson pickups described above, while retaining the essence of the Fender tonality. These pickups are shown in FIG. 10 and will be referred to herein as a "dual coil stacked humbucker pickup".

Qualitatively, the stacked humbucker pickup generates a bright and focused tone due to the narrow sensing field of the single row of stacked magnets. In the stacked humbucker pickup, a pair of coils are disposed in contact one on top of the other and share common magnetic pole pieces. Because of the stacked arrangement of the coils, the sensing field is quite narrow and therefore results in a focused tone. Stacked humbucker pickups benefit from the hum-canceling effect of the counter wound coil members.

In the past, many musicians have desired to play guitars that generate both Gibson tonalities and Fender tonalities. To meet these demands, a wide range of musical instruments have been proposed that utilize various combinations of the above-noted pickup types, arranged at various locations on the musical instrument body, to create the desired set of tonalities and tone blends.

Overall, these product offerings have met with limited success. Musicians have rejected guitars that produce entirely new tones, those that produce inferior Gibson or Fender tones, and those that introduce active electronics, new and different knobs or buttons, and multiple hard-to-use switches. One common approach has been to place one or more additional pickups on the guitar body. Due to the limited amount of space available, the additional pickups are often mounted directly in the middle of the guitar body at or near the pick area. This additional pickup tends to interfere with the musician's access to the strings and, further, creates a row of pickups that looks abnormal and unattractive. Multiple knobs, buttons and other electronic hardware have also been added to enable the auxiliary coils to be connected in various combinations. These additional controls have been complicated and difficult to learn and use.

It is therefore desirable to provide a guitar pickup system for use in an electric guitar for selecting from multiple Gibson and Fender tonalities.

It is further desirable to provide a pickup system for generating and selecting from multiple Fender and Gibson tonalities that is simple and intuitive to use for musicians that have a general knowledge of electric guitar basics.

It is further desirable to provide a pickup system that substantially produces Gibson and Fender tonalities without introducing pickups or other hardware in the pick area so that access to the strings remains free and unencumbered.

Accordingly, the present invention provides a new and improved pickup system in an electric guitar which overcomes the above-referenced problems and others.

SUMMARY OF THE INVENTION

The subject invention provides an electric guitar pickup system which includes a bridge pickup unit, a neck pickup unit, and a multiple position tonality select switch for selectively connecting the bridge and neck pickup units in a plurality of desired pickup combinations thereby selecting from a plurality of desired Fender and Gibson tonality signals from the electric guitar. The bridge pickup unit includes a dual coil flat humbucker pickup to produce Gibson tonalities and further includes a dual coil bridge stacked humbucker pickup to produce Fender tonalities. The neck pickup unit similarly includes a dual coil flat humbucker pickup together with a dual coil neck stacked humbucker pickup to produce both Gibson and Fender tonalities.

As can be seen from the foregoing, the primary object of the invention is the provision of a simple and easy-to-use pickup system for an electric guitar to enable generating and selecting from a plurality of desired Gibson and Fender tonality sounds.

A further object of the invention is the provision of a pickup system of the general type described which is aesthetically pleasing and provides a pair of pickup units on opposite sides of a pick area so that the guitar is readily familiar and therefore easily usable by most musicians.

A still further object is the provision of a five way tonality select switch disposed on the guitar body that enables the guitar to selectively produce a plurality of Gibson tonalities when the switch is in a first, third, or fifth position and to produce a plurality of Fender tonalities when the switch is in the second or fourth position.

Still yet a further object is the provision of a pair of push/pull switches integrated with standard rotary volume and tonal central knobs to enable a plurality of Gibson and Fender sub-tonalities to be generated based upon the position of the slide switch.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
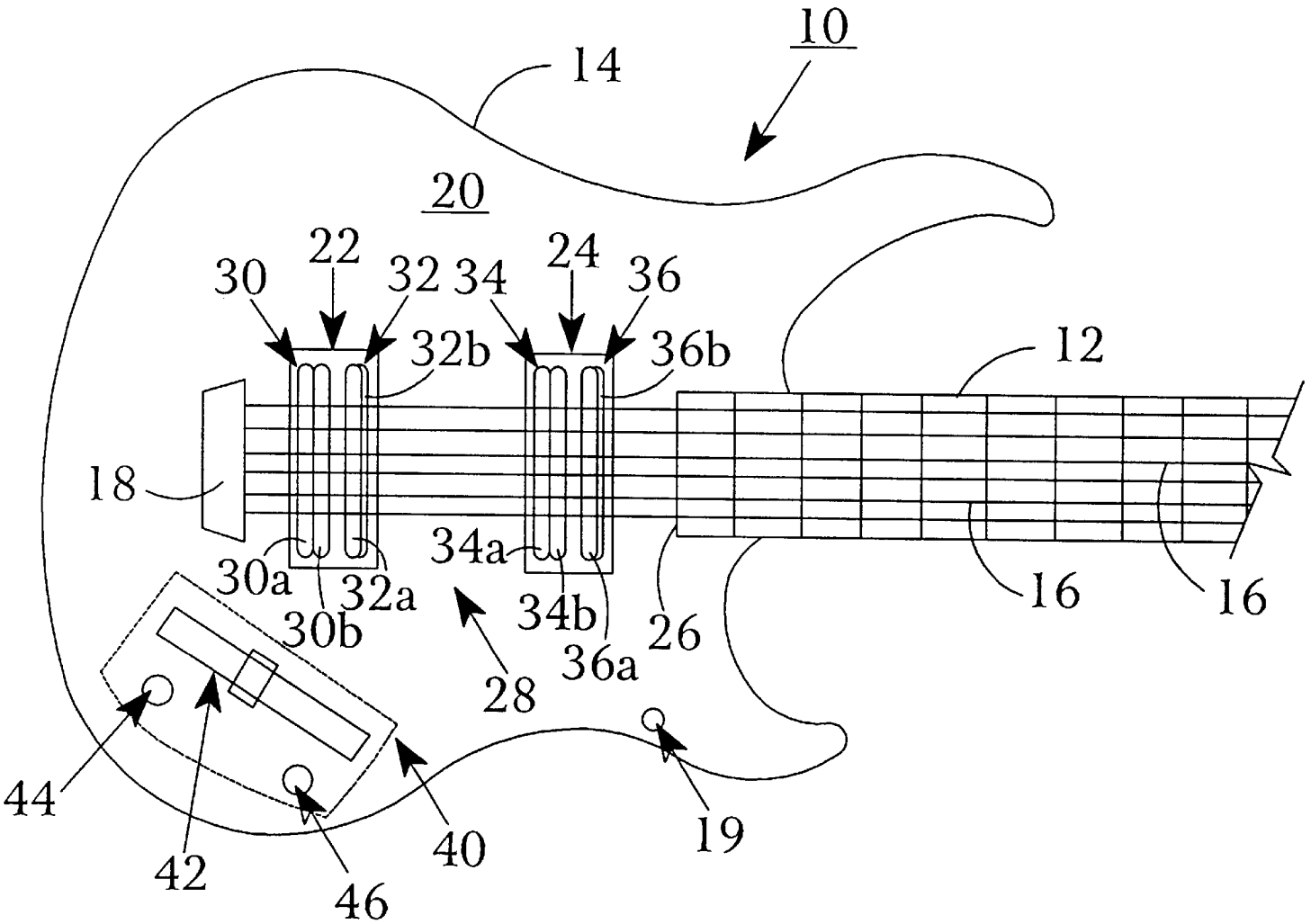
FIG. 1 is a plan view of a guitar body showing the preferred layout of the pair of pickup units and the tonality select switches of the pickup system of the present invention.

Referring now to the drawings wherein the showings are for the purposes of illustrating the preferred embodiment of the invention only and not for purposes of limiting same, FIG. 1 shows a guitar 10 provided with the subject pickup system of the invention and illustrating a portion of a neck or fingerboard 12 secured to a main body 14. The guitar 10 includes guitar strings 16 that are secured on one end to a bridge 18 and, on the other end, to a tuning head (not shown) in a manner well known in the art. A traditional ¼ inch open circuit jack 19 is provided to interface the electric pickup coils within the guitar 10 to associated electrical equipment such as amplifiers and the like in a well known manner.

In accordance with the present invention, a pair of pickup units 22, 24 are arrayed beneath the strings 16 and are secured onto the face 20 of the main body 14 of the guitar in a conventional manner. A first combination treble and rhythm dual coil humbucker pickup unit 22 is secured transversely beneath strings 16 and close to the bridge 18 as illustrated and in a position commonly referred in the art as the "bridge pickup position" In a similar manner, a second combination treble and rhythm dual coil humbucker pickup unit 24 is secured in a spaced apart parallel relationship relative to the first pickup unit 22 and closely adjacent and end 26 of the fingerboard 12. In this position, the second combination humbucker pickup unit 24 is commonly referred to as the "fingerboard position" or "neck pickup." One advantage of the illustrated preferred arrangement of the first and second humbucker pickup units 22, 24 on the guitar face 20 is that a gap 28 is created therebetween to form a generous pick area near the center of the guitar body in a traditional fashion.

As noted above, the first humbucker pickup unit 22 is a combination treble and rhythm dual coil humbucker pickup. To that end, the first pickup unit 22 preferably includes a dual coil bridge flat humbucker pickup 30 disposed between the bridge area 18 and the pick area 28 as shown. In addition, the first combination pickup unit 22 further includes a dual coil bridge stacked humbucker pickup 32 disposed between the bridge flat humbucker pickup 30 and the pick area 28. It is an advantage of the present invention that both the flat and stacked humbucker pickups 30, 32 fit within a "standard size" humbucker pickup unit cover, known in the art to be preferably about 1.5 inches by 2.75 inches in size.

Figure 8:
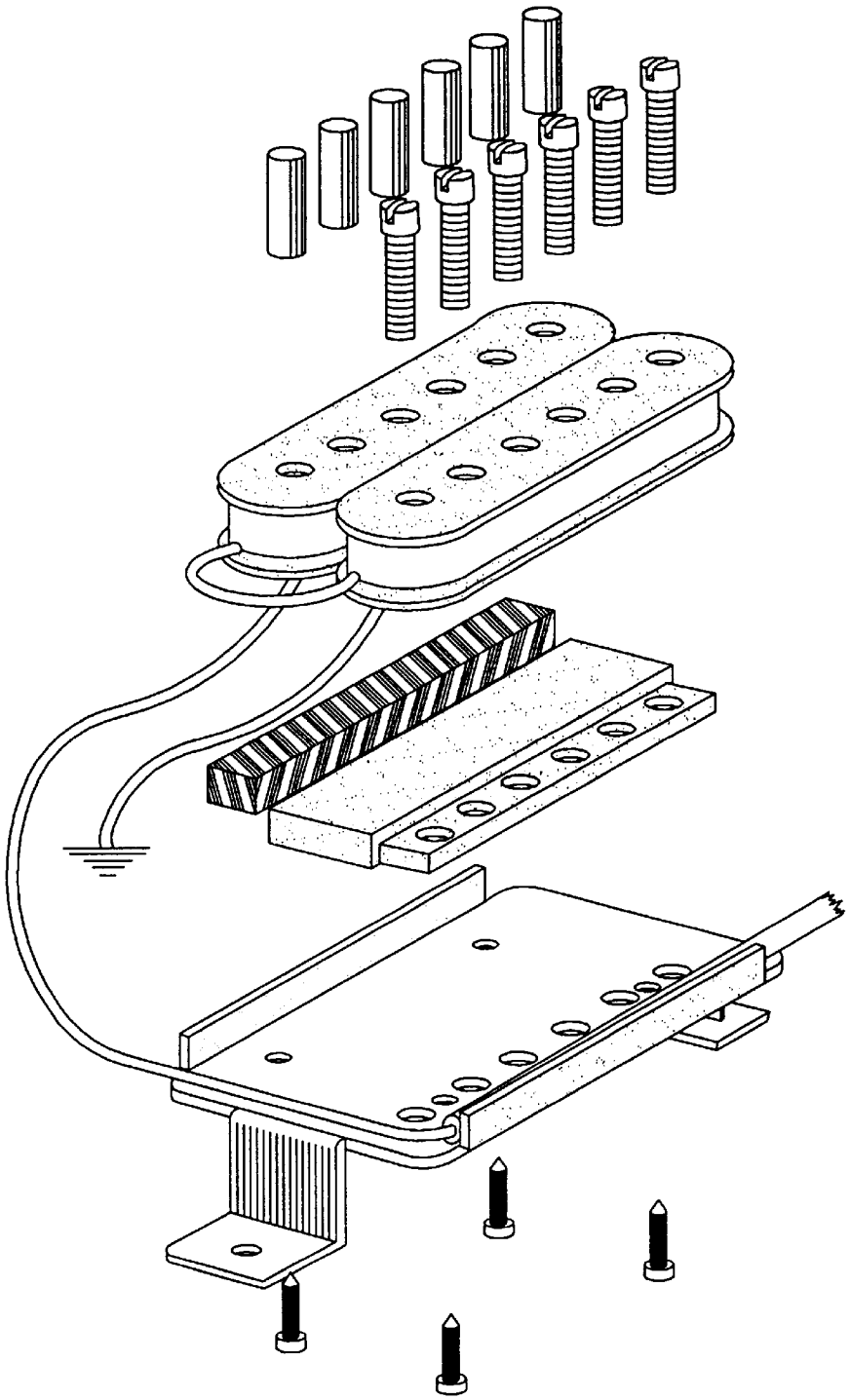
FIG. 8 (PRIOR ART)
FIG. 8 is a schematic illustration of a prior art "Gibson-type" flat humbucker pickup.
Figure 9:
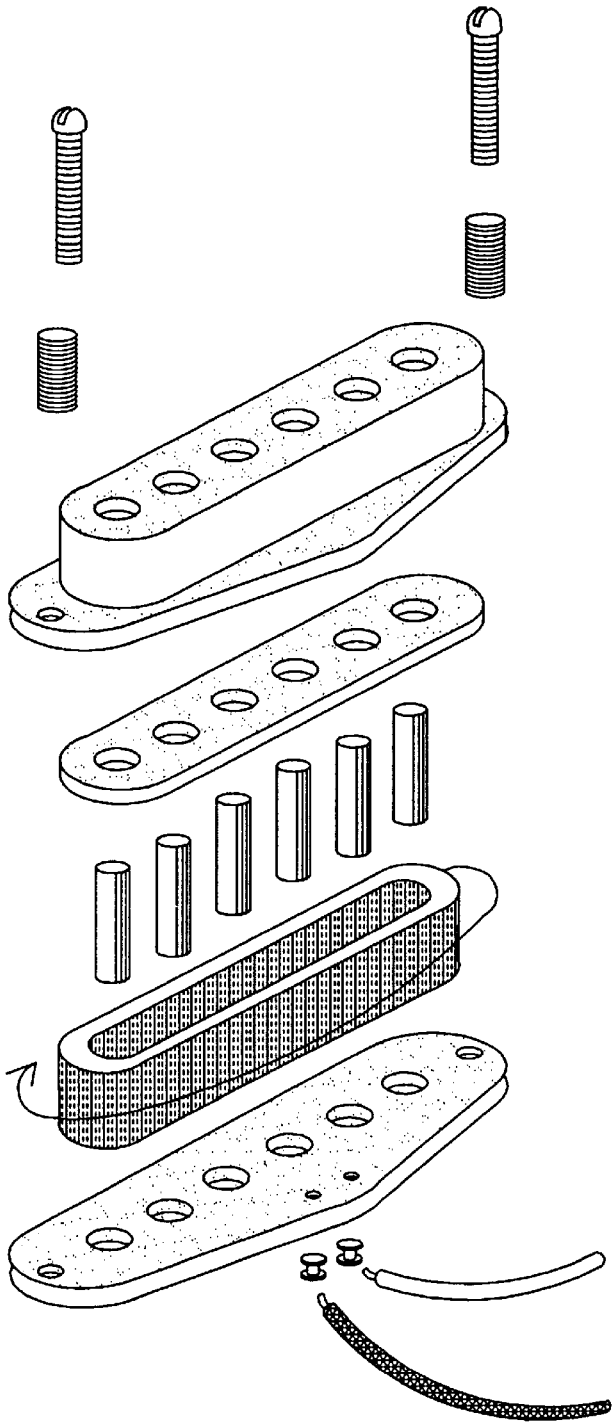
FIG. 9 (PRIOR ART)
FIG. 9 is a schematic illustration of a prior art "° Fender-type" single coil pickup; and, FIG. 10 is a schematic illustration of a prior art "Fender-type" stacked humbucker pickup.

Preferably, in accordance with the present invention, the bridge flat humbucker pickup 30 is formed substantially in a manner as taught in the prior art and illustrated in FIG. 8 for generating Gibson tonalities. As such, the bridge flat humbucker pickup 30 includes a pair of side-by-side coils 30*a*, 30*b* physically disposed within the bridge pickup unit 22 as shown in FIG. 1 and arranged electrically as shown best in FIG. 2.

Figure 2:
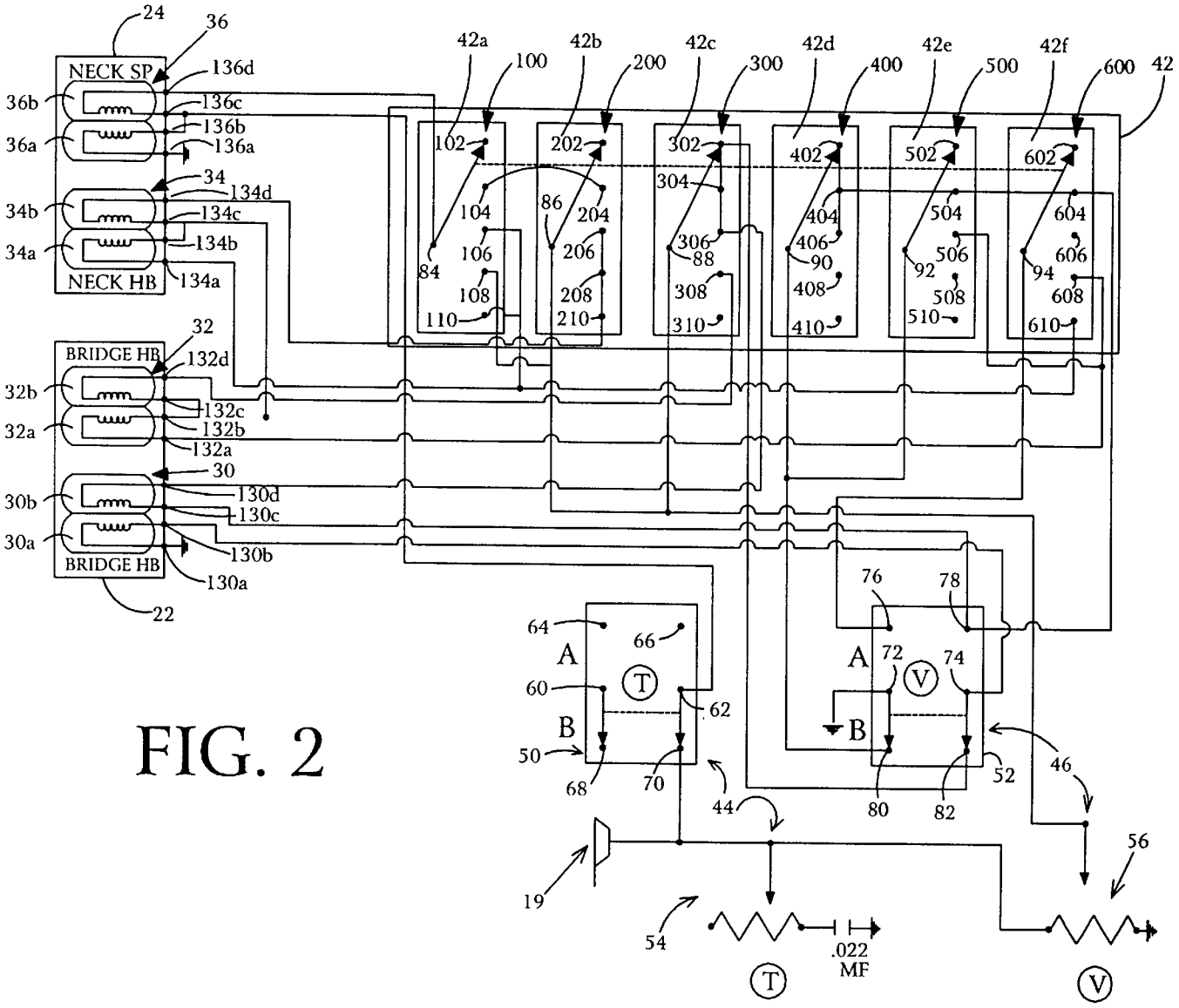
FIG. 2 is a schematic electrical diagram of the preferred embodiment guitar switching system of the present invention.
Figure 3A:
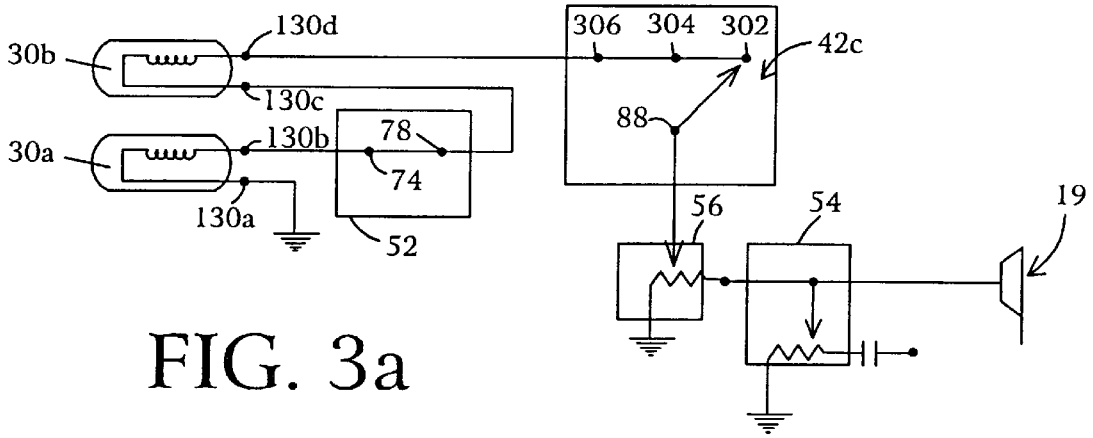
FIGS. 3*a*–3*d* are simplified schematic diagrams of the preferred embodiment showing the tonality slide switch in a first position and the pair of push/pull sub-tonality switches in various combinations.
Figure 3B:
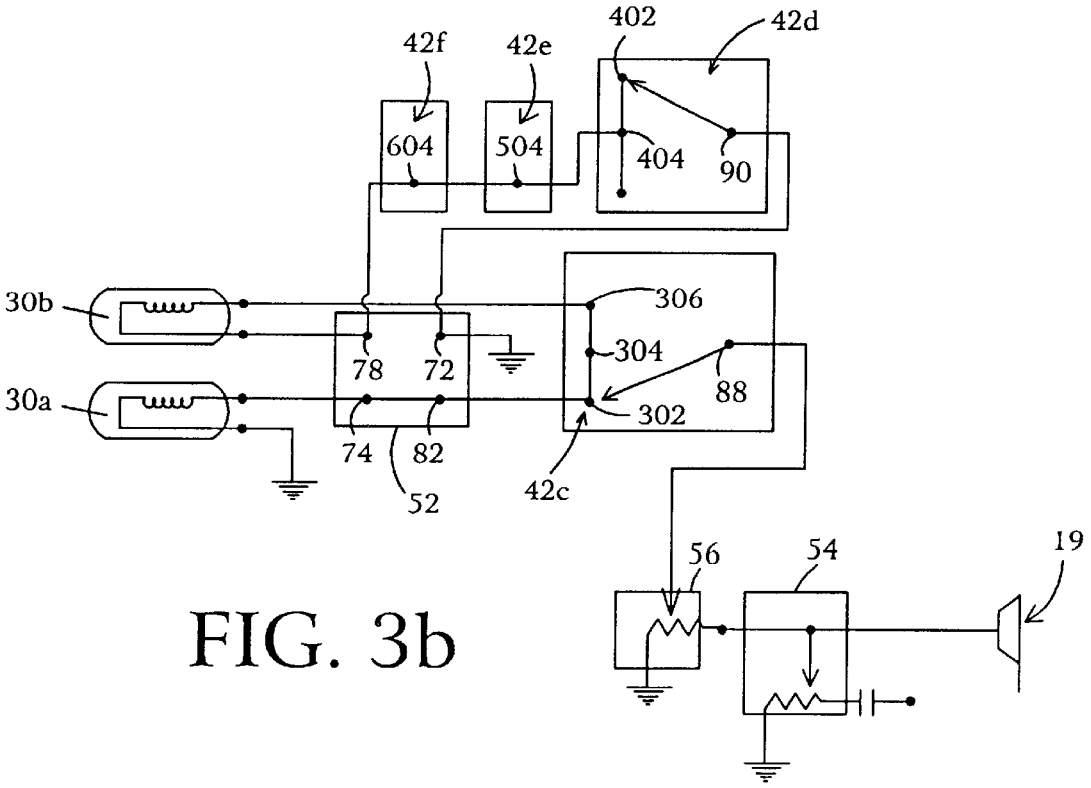
Figure 3C:
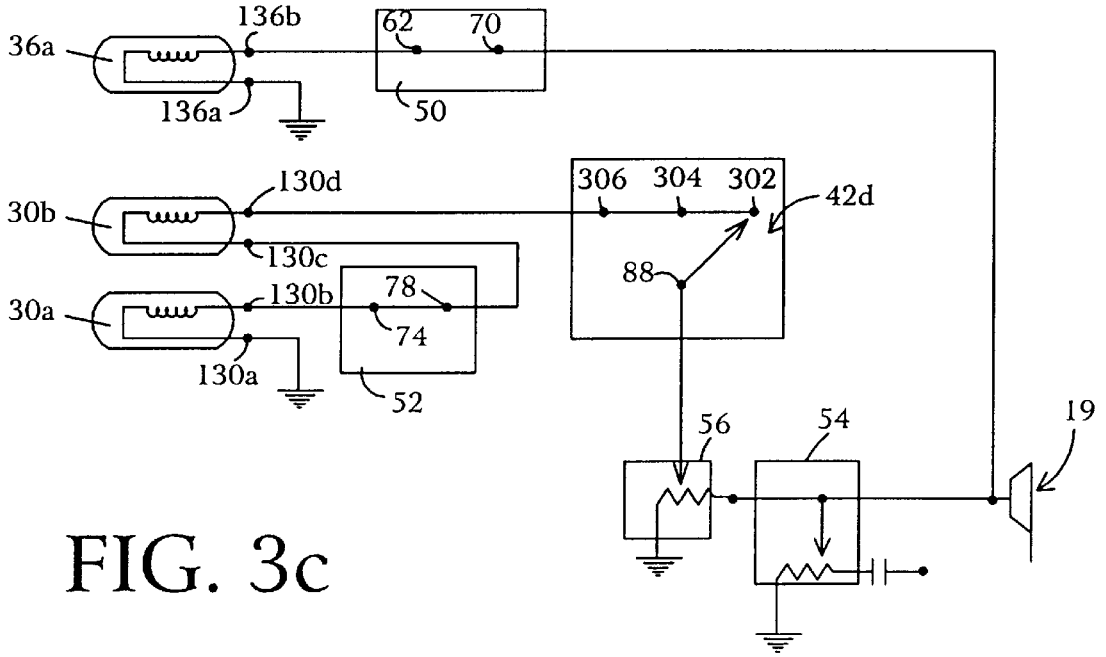
Figure 3D:
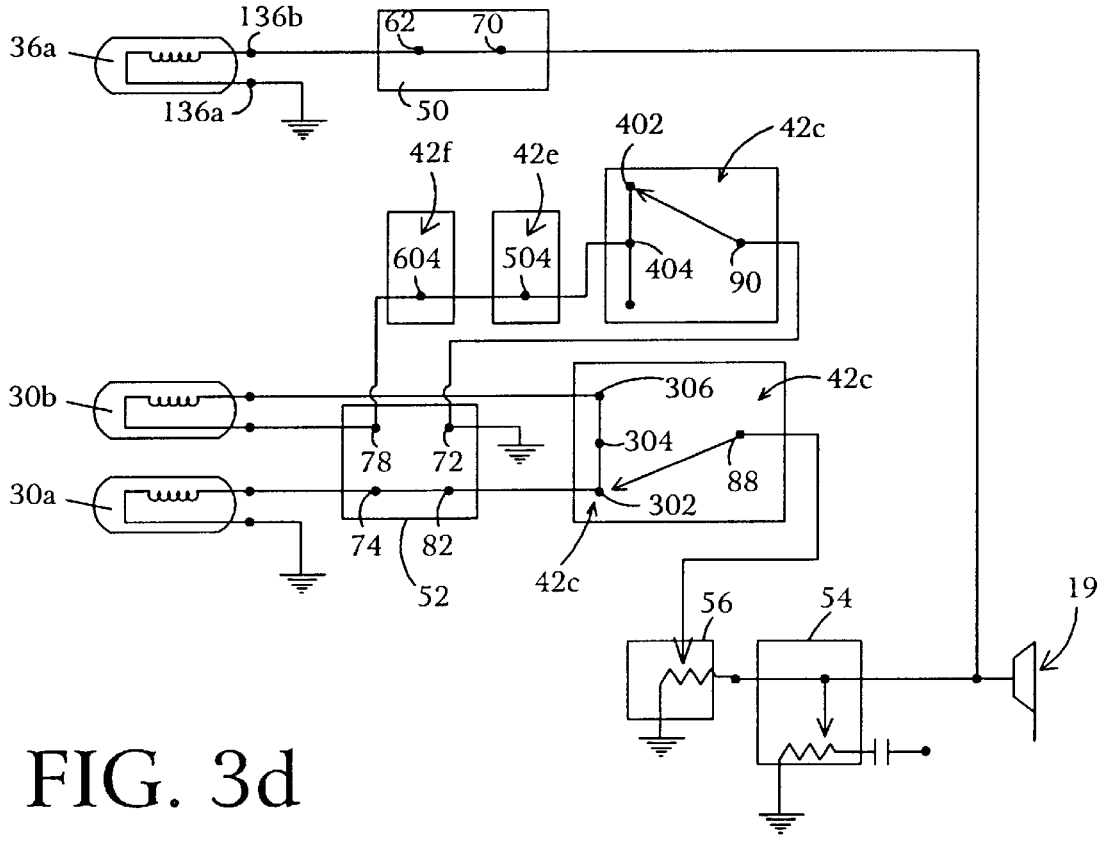
Figure 4A:
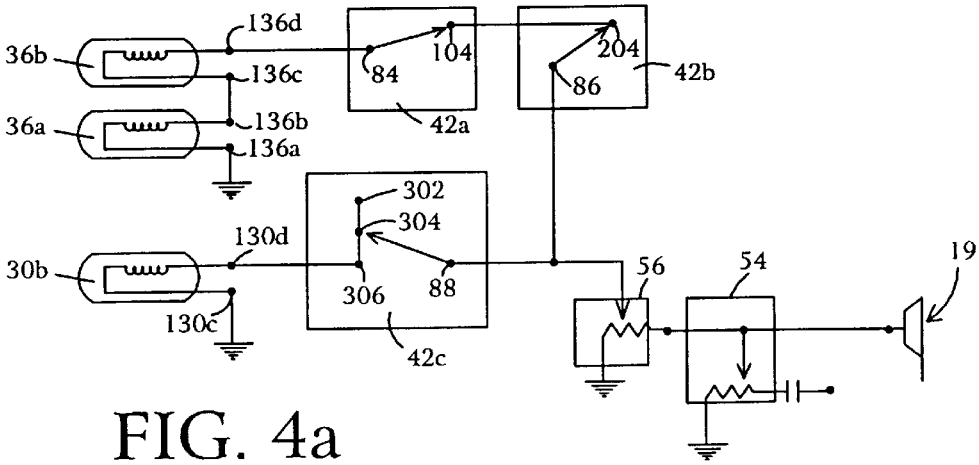
FIGS. 4*a*–4*d* are simplified schematic diagrams of the preferred embodiment showing the tonality slide switch in a second position and the pair of push/pull sub-tonality switches in various combinations.
Figure 4B:
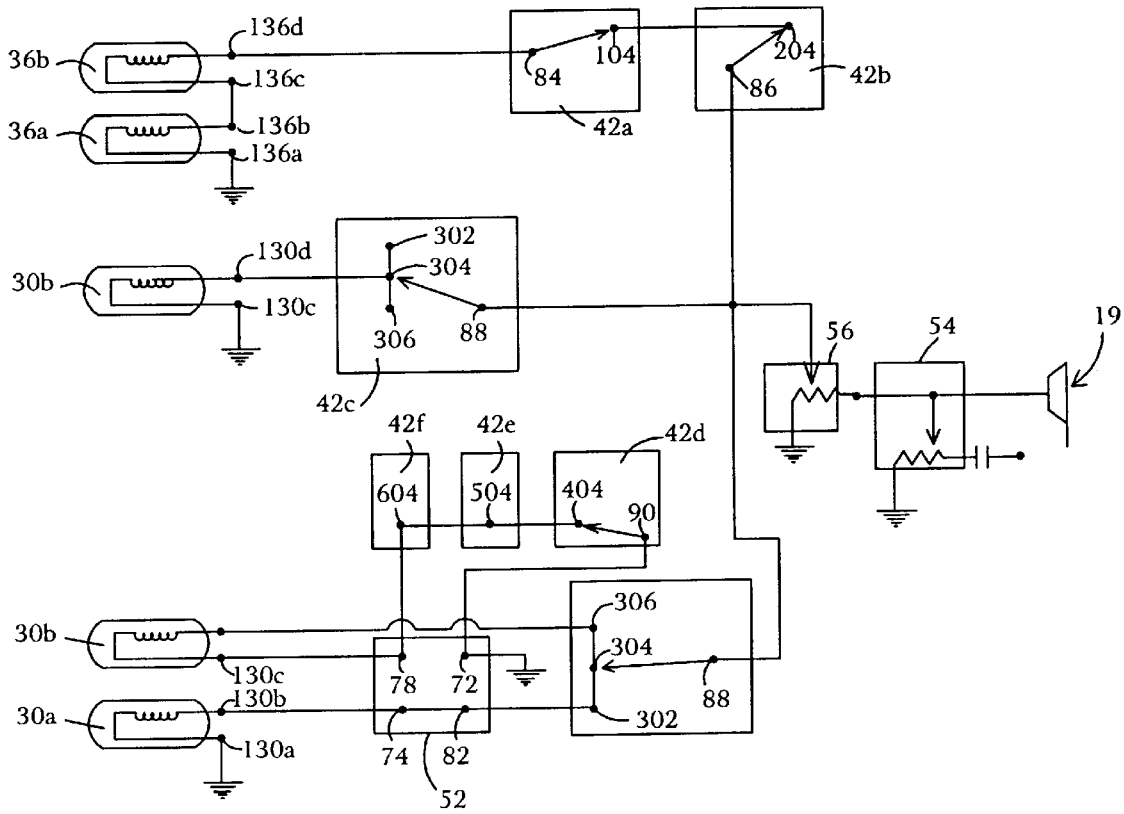
Figure 4C:
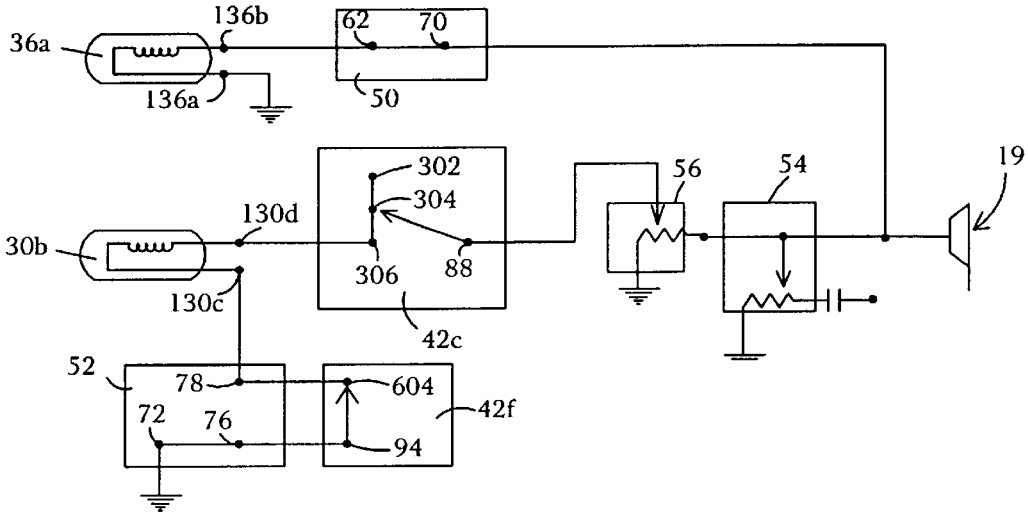
Figure 4D:
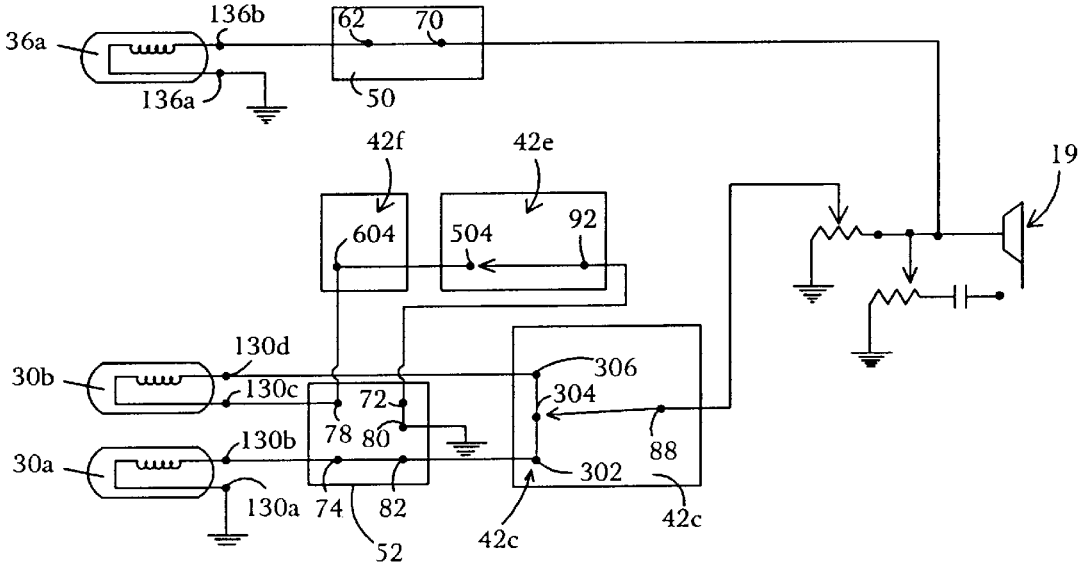
Figure 5A:
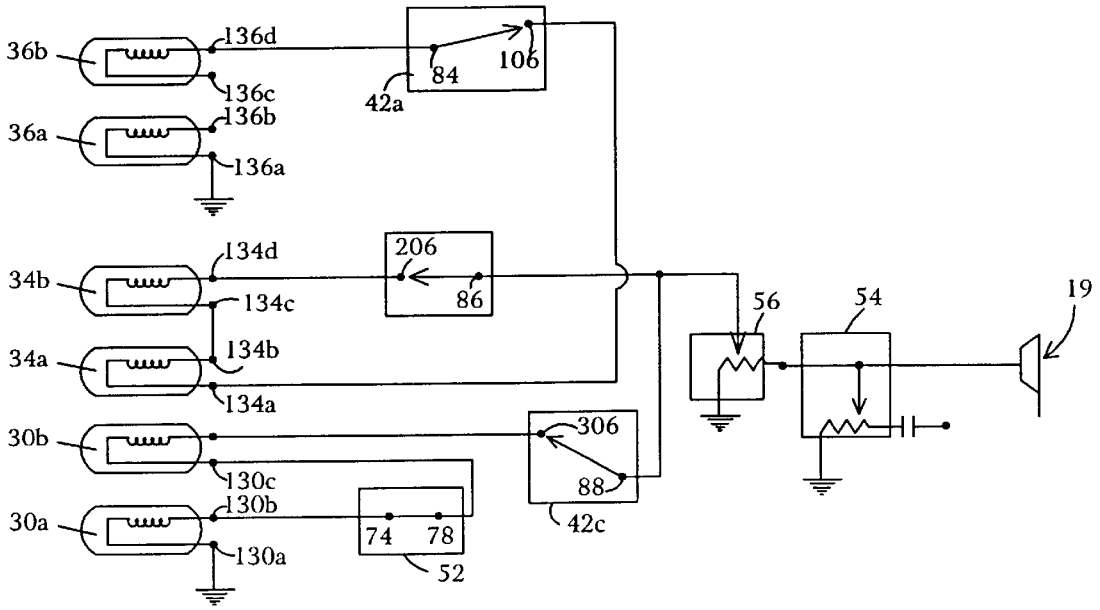
FIGS. 5*a*–5*d* are simplified schematic diagrams of the preferred embodiment showing the tonality slide switch in a third position and the pair of push/pull sub-tonality switches in various combinations.
Figure 5B:
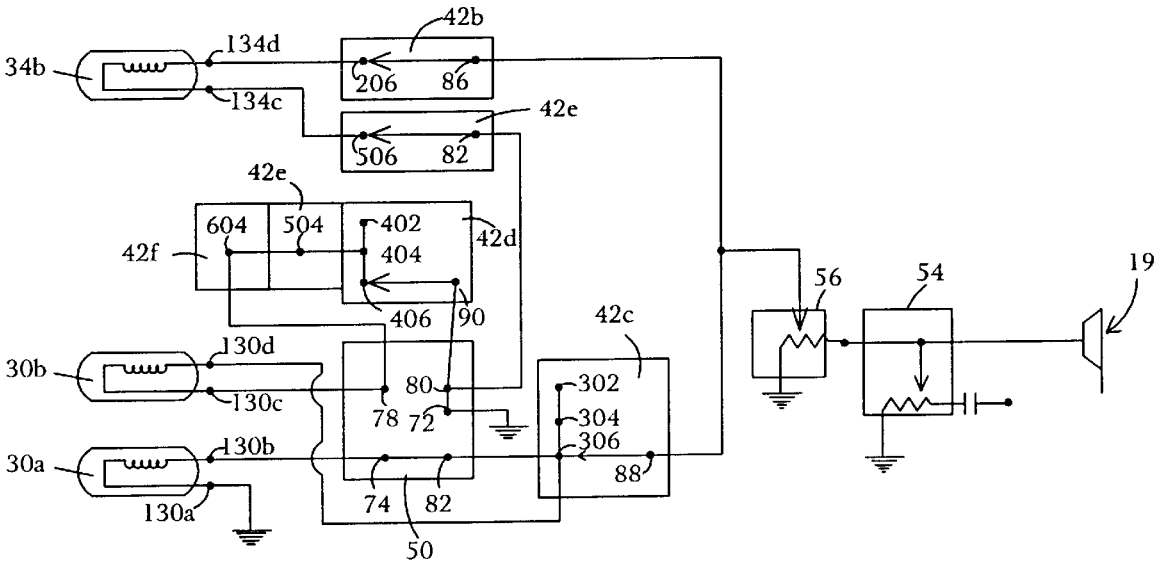
Figure 5C:
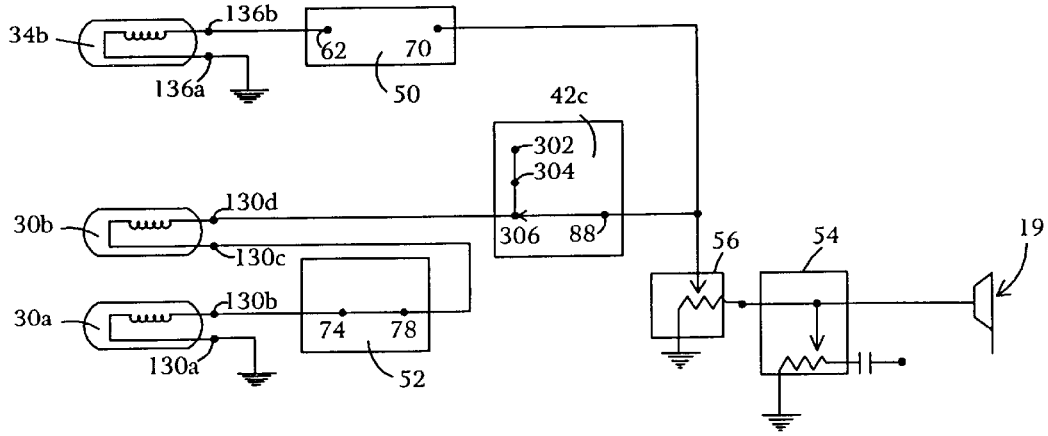
Figure 5D:
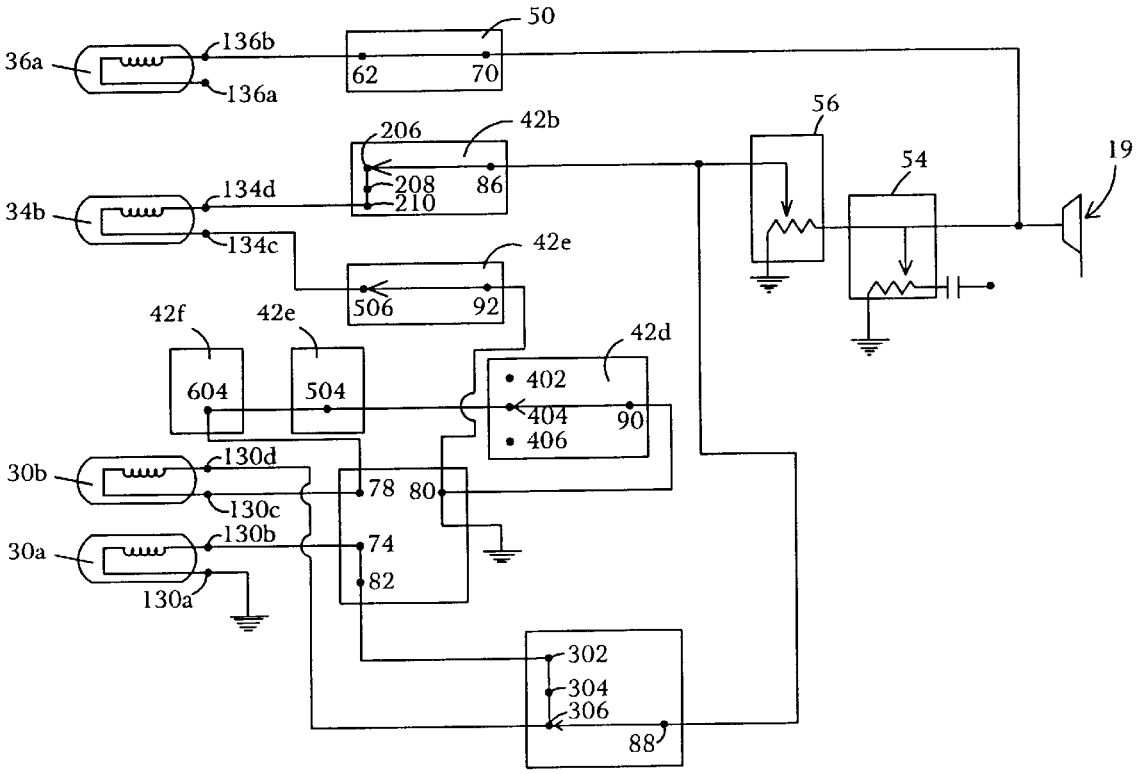
Figure 6A:
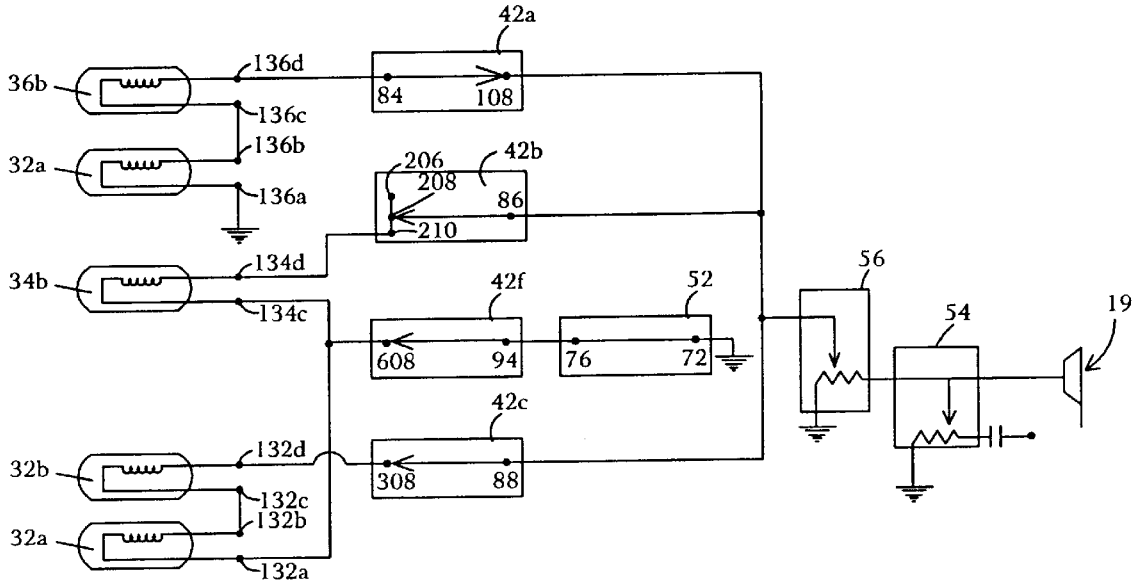
FIGS. 6*a*–6*d* are simplified schematic diagrams of the preferred embodiment showing the tonality slide switch in a fourth position and the pair of push/pull sub-tonality switches in various combinations.
Figure 6B:
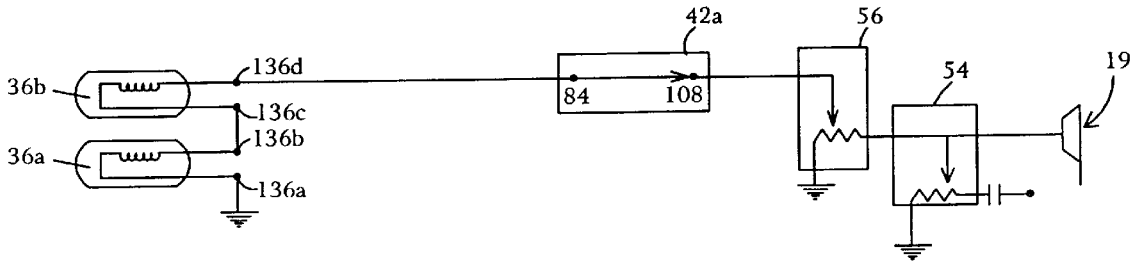
Figure 6C:
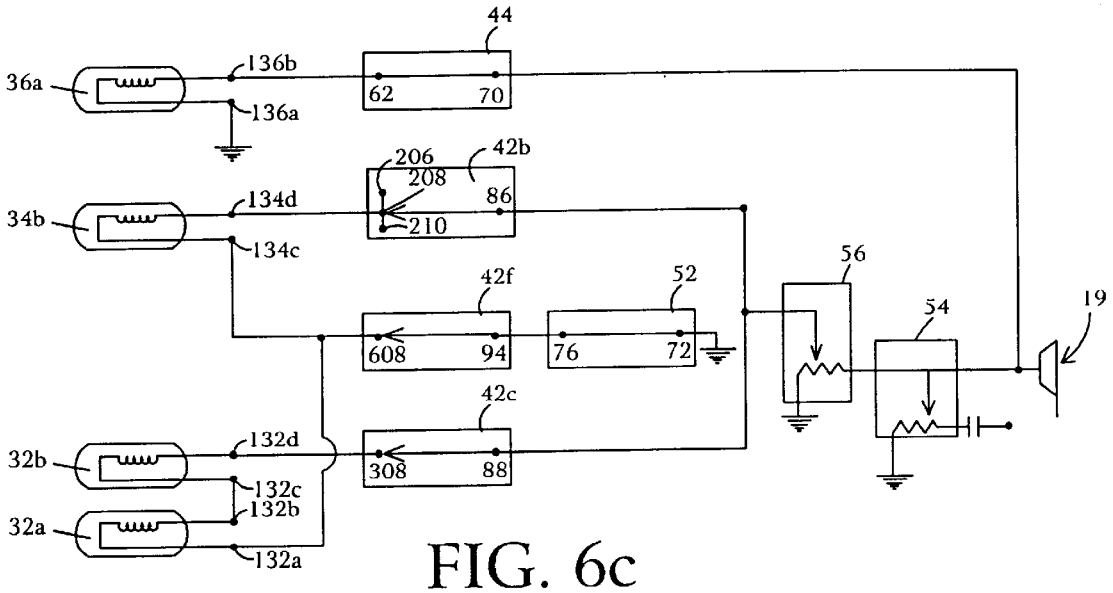
Figure 6D:
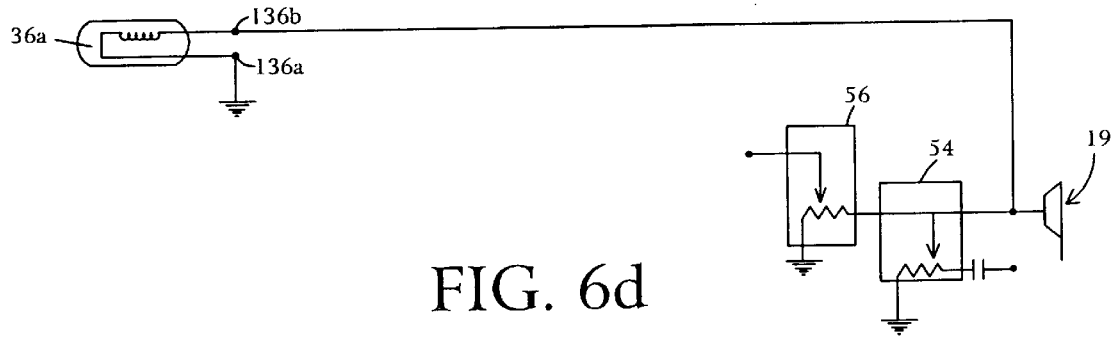
Figure 7A:
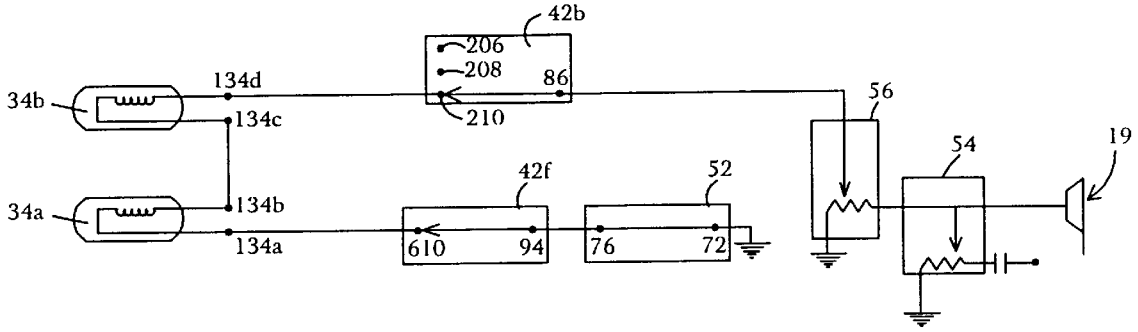
FIGS. 7*a*–7*d* are simplified schematic diagrams of the preferred embodiment showing the tonality slide switch in a fifth position and the pair of push/pull sub-tonality switches in various combinations.
Figure 7B:
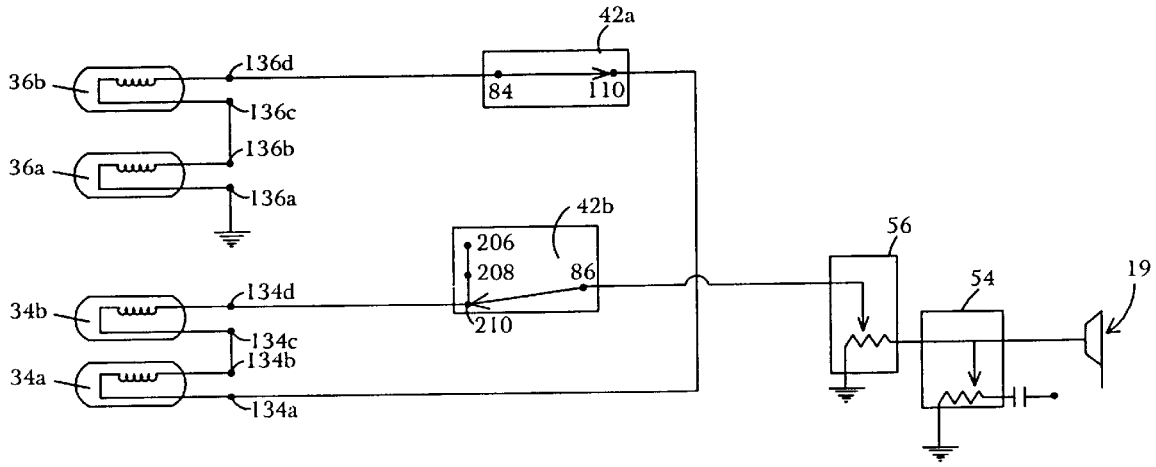
Figure 7C:
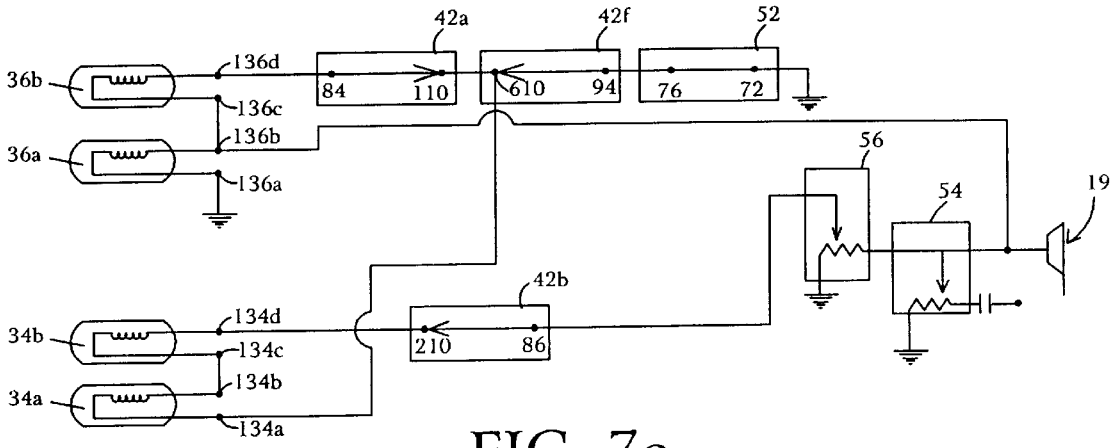
Figure 7D:
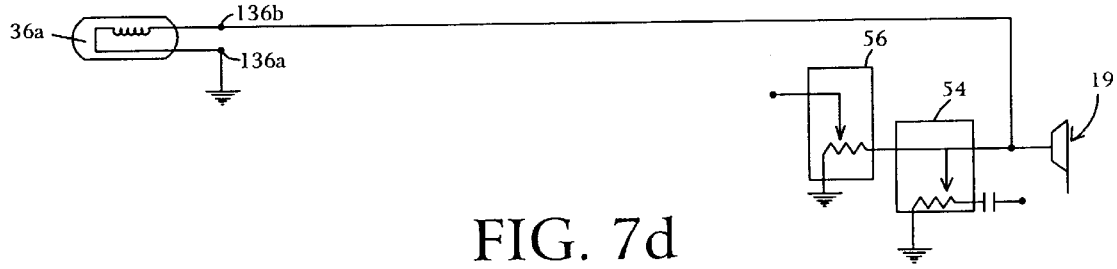
Figure 10:
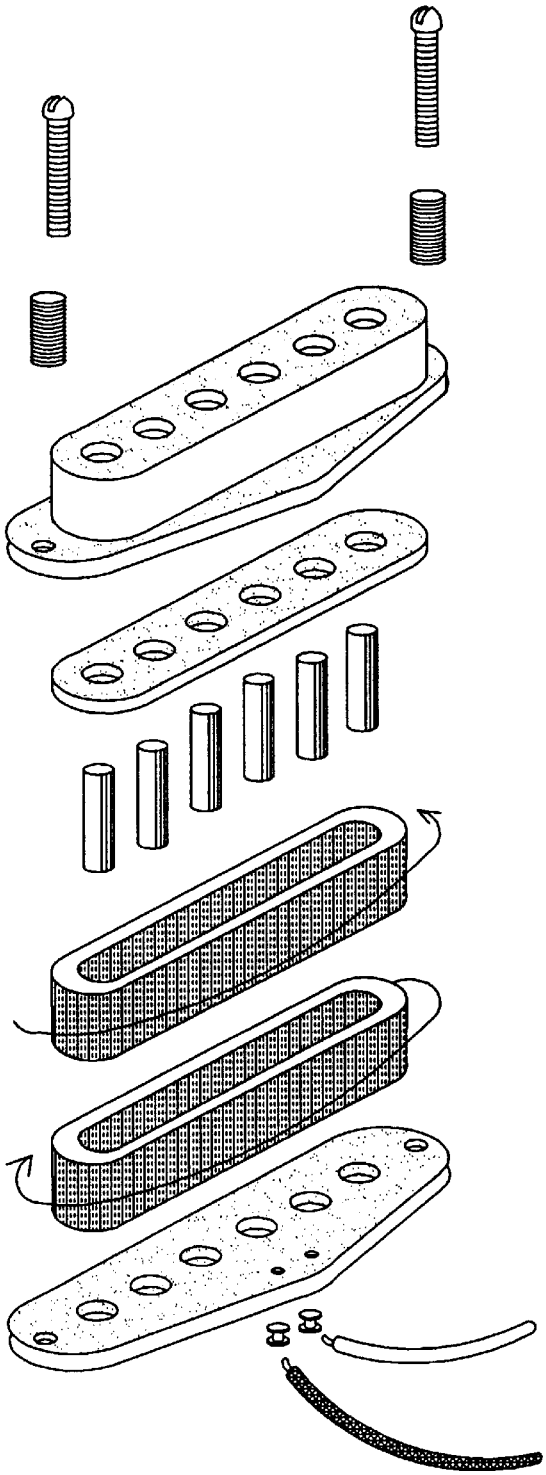
FIG. 10 (PRIOR ART)

Further preferably, in accordance with the present invention, the bridge stacked humbucker pickup 32 is formed substantially in a manner as taught in the prior art and illustrated in FIG. 10 for generating Fender tonalities. As such, the bridge stacked humbucker pickup 32 includes a pair of stacked coils 32*a*, 32*b* that are physically disposed within the bridge pickup unit 22, substantially as shown in FIG. 1 and arranged electrically as best shown in FIG. 2.

The neck humbucker pickup unit 24 is constructed substantially in a manner as the bridge humbucker pickup unit 22, described above. To that end, the second humbucker pickup unit 24 is a combination treble and rhythm dual coil humbucker pickup. Preferably, a dual coil neck flat humbucker pickup 34 is disposed between the pickup area 28 and the end 26 of the fingerboard neck, as shown. In addition, the second combination pickup unit 22 further includes a dual coil neck stacked humbucker pickup 36 disposed between the neck flat humbucker pickup 34 and the end 26 of the fingerboard area 12. It is an advantage of the present invention that both the flat and stacked humbucker pickups 34, 36 fit within a "standard size" humbucker pickup unit cover, known in the art to be preferably about 1.5 inches by 2.75 inches in size.

Preferably, in accordance with the present invention, the neck flat humbucker pickup 34 is formed substantially in a manner as taught in the prior art and illustrated in FIG. 8 for generating Gibson tonalities. As such, the neck flat humbucker pickup 34 includes a pair of side-by-side coils 34*a*, 34*b*, physically disposed within the neck pickup unit 24, as shown in FIG. 1 and arranged electrically as shown best in FIG. 2. The neck stacked humbucker pickup 36 is formed substantially in a manner as taught in the prior art and illustrated in FIG. 10 for generating Fender tonalities. As such, the neck stacked humbucker pickup 36 includes a pair of stacked coils 36*a*, 36*b*, that are physically disposed within the neck pickup unit 24 as shown in FIG. 1 and arranged electrically as best shown in FIG. 2.

In order to obtain the various Gibson and Fender tonalities and sub-tonalities at the output jack 19, the present invention further includes tonality select switch means 40, preferable located near the bottom end of the guitar main body 14 in a manner shown in FIG. 1. In accordance with the present invention, the switch means 40 includes at least one primary tonality select switch 42 and a pair of secondary tonality select switches 44, 46. Preferably, the primary tonality select switch 42 is a multi-position slider-type switch and the pair of secondary tonality select switches 44, 46 are integrated as push/pull movements into standard rotary volume and tone controls typically associated with most guitars. In that regard, it is to be noted that the tonality select switch means 40 looks and feels like standard guitar controls that are familiar to musicians and, accordingly, presents a non-intimidating interface to the subject pickup system for producing Gibson and Fender tonalities at the output jack 19.

With particular reference now to FIG. 2, the primary tonality select switch 42, used for selecting the desired tonality signal is preferably a six pole, five position switch. The primary tonality select switch 42 connects the coils of the bridge flat humbucker pickup 30, the bridge stacked humbucker pickup 32, the neck flat humbucker pickup 34, and the neck stacked humbucker pickup 36 in various preferred selectable combinations as shown. The combined coil connections are delivered to the output jack 19 through the volume and tone controls to produce selected Gibson and Fender sounds from the guitar 10.

Further in accordance with the invention, the secondary tonality select switches 44, 46 each include a two pole, two position switch 50, 52, respectively. As illustrated in FIG. 2 and noted above, the first secondary tonality select switch 44 includes a push/pull two pole, two position switch 50 that is integrated into a standard rotary tone control knob commonly used in the industry. The rotary motion essentially actuates a potentiometer 54 in a well-known manner for tone control. Similarly, the second secondary tonality select switch 46 includes a push/pull two pole, two position switch portion 52 that is integrated into a standard rotary volume control knob including a volume potentiometer 56. The rotary motion of the second secondary tonality select switch 46 essentially actuates a potentiometer 56 in a well-known manner to effect volume control.

The first two pole, two position switch 50 includes a pair of common terminals 60, 62 that are each respectively connected to a first set of terminals 64, 66 when the switch 50 is in a first position A and, similarly, are connected to a second set of terminals 68, 70 when the switch 50 is disposed in a second position B. In a like fashion, the second two pole, two position switch 52 includes a pair of common terminals 72, 74 that are each respectively connected to a first set of terminal 76, 78 when the switch 52 is in a first position A, and are connected to a second set of terminals 80, 82 when the switch 52 is in a second position B. It is an advantage of the invention that the secondary tonality select switches 44, 46 can be actuated without disturbing the rotary volume or tone control control settings.

As noted above, the primary tonality select switch 42 is preferably a six pole, five position switch. Accordingly, the switch includes set of first through sixth poles 84–94 shown. The first pole 84 is selectively connectable to a first set 100 of first through fifth terminals 102, 104, 106, 108, and 110. Similarly, the second through sixth poles 86–94 are each selectively connectable to second through sixth sets 200–600 of first through fifth terminals 202–210, 302–310, 402–410, 502–510, and 602–610, respectively as shown.

More particularly, the primary tonality select switch 42 has a second set 200 of first through fifth terminals 202, 204, 206, 208, and 210. The second pole 86 is connected to the volume potentiometer 56 as illustrated. The third through sixth terminals 206, 208, and 210 are each connected to a node 134*d* of the neck flat humbucker pickup 34*b*. The second terminal 204 among the second set of terminals 200 is connected directly to the second terminal 204 among the first set 100 as shown.

The first through third terminals 302–306 of the third set of terminals 300 are connected together within the switch and are further connected on one end to node 130*d* of the bridge flat humbucker pickup coil 30*b*. The fourth terminal 308 is connected directly to a node 132*d* of the bridge stacked humbucker pickup coil 32*b*. The third pole 88 of the switch 42 is connected directly to the second pole 86 as shown. The second and third poles 86, 88 are in turn connected directly to the jack output 18 through the volume potentiometer 56.

The first through third terminals 402–406 are each connected directly to the second terminals 504, 604 from the fifth and sixth terminal sets 500, 600 as shown. In turn, the above terminals are connected directly to terminal 78 among the second set of terminals in the two pole, two position switch 52, as illustrated. The fourth and fifth poles 90, 92 of the five way switch 42 are connected together and in turn directly to terminal 80 of the two pole, two position switch 52.

The fourth terminal 608 among the fifth set of terminals 600 is connected directly to node 132*a* of the bridge stacked humbucker pickup coil 32*a* as shown. In the same switch, the fifth terminal 610 is connected directly to the third terminal 106 and in turn to node 134*a* of the neck flat humbucker pickup coil 34*a*.

Other electrical interconnections are included as well, Preferably, the node 134*c* of the neck flat humbucker pickup coil 34*b* is connected directly to the fourth terminal 608 among the sixth set of terminals 600 and, in turn, to node 132*a* of the bridge stacked humbucker pickup 32*a*. In addition, nodes 136*b* and 136*c* of the neck stacked humbucker pickup coils 36*a*, 36*b* are connected directly to the common terminal 62 of the two pole, two position switch 50 as shown. An output terminal 70 of the two position switch 50 is connected directly to the jack 19 and also to the tone potentiometer 54.

Table I below summarizes the set of coil connections that are made in accordance with the pickup system of the present invention to produce Gibson "lead-type" tonalities. Selected coils within the bridge and neck pickup units 22, 24 are recruited for connection to the output jack 19 when the primary tonality select switch 42 is disposed in a first position so that the poles 84, 86, 88, 90, 92, 94 are each connected to the first terminals 102, 202, 302, 402, 502, and 602, respectively. The secondary tonality select switches 44, 46 are used to slightly modify the coil connection made with the select switch 42 in the first position to generate modified Gibson lead-type tonalities. For each switch combination described in Table I, a corresponding simplified circuit diagram is shown in FIGS. 3*a*–3*d* to illustrate the various connections of the coils within the bridge and neck pickup units 22, 24.

TABLE I

| 5-way Switch (42) in FIRST Position 84/102, 86/202, 88/302, 90/402, 92/502, 94/602 | | | |
|---|---|---|---|
| 1st Two Pole (50) Position | 2nd Two Pole (52) Position | Coil Connection | Representative FIG. |
| A | A | Series 30a, 30b | 3a |
| A | B | Parallel 30a, 30b | 3b |
| B | A | (Series 30a, 30b) Parallel with 36a | 3c |
| B | B | (Parallel 30a, 30b) Parallel with 36a | 3d |

Table II below summarizes the set of coil connections that are made in accordance with the pickup system of the present invention to produce Fender "twang-type" or "Telecaster-type" tonalities. Selected coils within the bridge and neck pickup units 22, 24 are recruited for connection to the output jack 19 when the primary tonality select switch 42 is disposed in a second position so that the poles 84, 86, 88, 90, 92, and 94 are each connected to the second terminals 104, 204, 304, 404, 504, and 604, respectively. The secondary tonality select switches 44, 46 are used to slightly modify the coil connection made with the select switch 42 in the second position to generate modified Fender "Telecaster-type" tonalities. For each switch combination described in Table II, a corresponding simplified circuit diagram is shown in FIGS. 4*a*–4*d* to illustrate the various connections of the coils within the bridge and neck pickup units 22, 24.

TABLE II

| 5-way Switch (42) in SECOND Position 84/104, 86/204, 88/304, 90/404, 92/504, 94/604 | | | |
|---|---|---|---|
| 1st Two Pole (50) Position | 2nd Two Pole (52) Position | Coil Connection | Representative FIG. |
| A | A | (Series 36a, 36b) Parallel with 30b | 4a |
| A | B | (Series 36a, 36b) Parallel with (Parallel 30a, 30b) | 4b |
| B | A | Parallel 30b, 36a | 4c |
| B | B | (Parallel 30a, 30b) Parallel with 36a | 4d |

Table III below summarizes the set of coil connections that are made in accordance with the pickup system of the present invention to produce Gibson "dual rhythm-type" tonalities. Selected coils within the bridge and neck pickup units 22, 24 are recruited for connection to the output jack 19 when the primary tonality select switch 42 is disposed in a third position so that the poles 84, 86, 88, 90, 92, and 94 are each connected to the third terminals 106, 206, 306, 406, 506, and 606, respectively. The secondary tonality select switches 44, 46 are used to slightly modify the coil connection made with the select switch 42 in the third position to generate modified Gibson dual rhythm-type tonalities. For each switch combination described in Table III, a corresponding simplified circuit diagram is shown in FIGS. 5*a*–5*d* to illustrate the various connections of the coils within the bridge and neck pickup units 22, 24.

TABLE III

| 5-way Switch (42) in THIRD Position 84/106, 86/206, 88/306, 90/406, 92/506, 94/606 | | | |
|---|---|---|---|
| 1st Two Pole (50) Position | 2nd Two Pole (52) Position | Coil Connection | Representative FIG. |
| A | A | ((Series 36a, 36b) series with (Series 34a, 34b)) Parallel with (Series 30a, 30b) | 5a |
| A | B | (Parallel 30a, 30b) Parallel with 34b | 5b |
| B | A | (Series 30a, 30b) Parallel with 36a | 5c |
| B | B | (Parallel 30a, 30b) Parallel with 36a Parallel with 34b | 5d |

Table IV below summarizes the set of coil connections that are made in accordance with the pickup system of the present invention to produce Fender "Stratocaster-type" tonalities. Selected coils within the bridge and neck pickup units 22, 24 are recruited for connection to the output jack 19 when the primary tonality select switch 42 is disposed in a fourth position so that the poles 84, 86, 88, 90, 92, and 94 are each connected to the fourth terminals 108, 208, 308, 408, 508, and 608, respectively. The secondary tonality select switches 44, 46 are used to slightly modify the coil connection made with the select switch 42 in the fourth position to generate modified Fender "Stratocaster-type" tonalities. For each switch combination described in Table IV, a corresponding simplified circuit diagram is shown in FIGS. 6*a*–6*d* to illustrate the various connections of the coils within the bridge and neck pickup units 22, 24.

TABLE IV

| 5-way Switch (42) in FOURTH Position 84/108, 86/208, 88/308, 90/408, 92/508, 94/608 | | | |
|---|---|---|---|
| 1st Two Pole (50) Position | 2nd Two Pole (52) Position | Coil Connection | Representative FIG. |
| A | A | (Series 36a, 36b) Parallel with 34b Parallel with (Series 32a, 32b) | 6a |
| A | B | Series 36a, 36b | 6b |
| B | A | (Series 32a, 32b) Parallel with 36a Parallel with 34b | 6c |
| B | B | 36a | 6d |

Table V below summarizes the set of coil connections that are made in accordance with the pickup system of the present invention to produce Gibson "Les Paul rhythm-type" tonalities. Selected coils within the bridge and neck pickup units 22, 24 are recruited for connection to the output jack 19 when the primary tonality select switch 42 is disposed in a fifth position so that the poles 84, 86, 88, 90, 92, and 94 are each connected to the fifth terminals 110, 210, 310, 410, 510, and 610, respectively. The secondary tonality select switches 44, 46 are used to slightly modify the coil connection made with the select switch 42 in the fifth position to generate modified Gibson Les Paul tonalities. For each switch combination described in Table V, a corresponding simplified circuit diagram is shown in FIGS. 7*a*–7*d* to illustrate the various connections of the coils within the bridge and neck pickup units 22, 24.

TABLE V

| 5-way Switch (42) in FIFTH Position 84/110, 86/210, 88/310, 90/410, 92/510, 94/610 | | | |
|---|---|---|---|
| 1st Two Pole (50) Position | 2nd Two Pole (52) Position | Coil Connection | Representative FIG. |
| A | A | Series 34a, 34b | 7a |
| A | B | (Series 36a, 36b) Series with (Series 34a, 34b) | 7b |
| B | A | (Series 36a, 36b) Parallel with (Series 34a, 34b) | 7c |
| B | B | 36a | 7c |

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A pickup system for use in an electric guitar having an output jack and a set of strings extending over a pick area on a guitar body from a bridge area on the guitar body to a fingerboard neck adjacent to the body, the pickup system comprising:

a dual coil bridge flat humbucker pickup disposed between the bridge area and the pick area;

a dual coil bridge stacked humbucker pickup disposed between the dual coil bridge flat humbucker pickup and the pick area;

a dual coil neck flat humbucker pickup disposed between the pick area and the fingerboard neck;

a dual coil neck stacked humbucker pickup disposed between the dual coil neck flat humbucker pickup and the fingerboard neck; and, a tonality select switch for selectively connecting the dual coil bridge and neck flat humbucker pickups with the dual coil bridge and neck stacked humbucker pickups to said output jack in a plurality of desired pickup combinations thereby selecting a plurality of desired tonality signals from said electric guitar.

2. The pickup system according to claim 1 wherein the tonality select switch includes a five position switch adapted to:

when in a first position, connect the dual coil bridge and neck flat humbucker pickups with the dual coil bridge and neck stacked humbucker pickups to said output jack in a first desired pickup combination thereby selecting a first tonality signal from said electric guitar;

when in a second position, connect the dual coil bridge and neck flat humbucker pickups with the dual coil bridge and neck stacked humbucker pickups to said output jack in a second desired pickup combination thereby selecting a second tonality signal from said electric guitar;

when in a third position, connect the dual coil bridge and neck flat humbucker pickups with the dual coil bridge and neck stacked humbucker pickups to said output jack in a third desired pickup combination thereby selecting a third tonality signal from said electric guitar;

when in a fourth position, connect the dual coil bridge and neck flat humbucker pickups with the dual coil bridge and neck stacked humbucker pickups in a fourth desired pickup combination thereby selecting a fourth tonality signal from said electric guitar; and, when in a fifth position, connect the dual coil bridge and neck flat humbucker pickups with said dual coil bridge and neck stacked humbucker pickups to said output jack in a fifth desired pickup combination thereby selecting a fifth tonality signal from said electric guitar.

3. The pickup system according to claim 2 wherein the tonality select switch includes at least one secondary tonality select switch adapted to:

selectively modify said first desired pickup combination thereby selecting a modified first tonality signal from said electric guitar;

selectively modify said second desired pickup combination thereby selecting a modified second tonality signal from said electric guitar;

selectively modify said third desired pickup combination thereby selecting a modified third tonality signal from said electric guitar;

selectively modify said fourth desired pickup combination thereby selecting a modified fourth tonality signal from said electric guitar; and, selectively modify said fifth desired pickup combination thereby selecting a modified fifth tonality signal from said electric guitar.

4. The pickup system according to claim 3 wherein the secondary tonality select switch is adapted to:

selectively modify said first desired pickup combination thereby selecting a plurality of modified first tonality signals from said electric guitar;

selectively modify said second desired pickup combination thereby selecting a plurality of modified second tonality signals from said electric guitar;

selectively modify said third desired pickup combination thereby selecting a plurality of modified third tonality signals from said electric guitar;

selectively modify said fourth desired pickup combination thereby selecting a plurality of modified fourth tonality signals from said electric guitar; and, selectively modify said fifth desired pickup combination thereby selecting a plurality of modified fifth tonality signals form said electric guitar.

5. The pickup system according to claim 4 wherein:

the tonality select switch is a six pole, five position switch; and, the at least one secondary tonality select switch includes a pair of double pole, two position switches.

6. The pickup system according to claim 2 wherein:

said five position switch generates said first desired pickup combination as a series connection of said first coil of said dual coil bridge flat humbucker pickup and a second coil of said dual coil bridge flat humbucker pickup delivered to said output jack;

the five position switch generates said second desired pickup combination as a series connection of a first coil of said dual coil neck stacked humbucker pickup and a second coil of said dual coil neck stacked humbucker pickup in parallel with said first coil of said dual coil bridge flat humbucker pickup delivered to said output jack;

the five position switch generates said third desired pickup combination as a series connection of said first coil of said dual coil neck stacked humbucker pickup and said second coil of said dual coil neck stacked humbucker pickup in parallel with a series connection of a first coil of said dual coil neck flat humbucker pickup and a second coil of said dual coil neck flat humbucker pickup in parallel with a series connection of said first coil of said dual coil bridge flat humbucker pickup and said second coil of said dual coil bridge flat humbucker pickup (30) delivered to said output jack;

the five position switch generates said fourth desired pickup combination as a series connection of said first coil of said dual coil neck stacked humbucker pickup and said second coil of said dual coil neck stacked humbucker pickup in parallel with a series connection of a first coil of said dual coil bridge stacked humbucker pickup and a second coil of said dual coil bridge stacked humbucker pickup in parallel with said second coil of said dual coil neck flat humbucker pickup delivered to said output jack; and, the five position switch generates said fifth desired combination as a series connection of said first coil of said dual coil neck flat humbucker pickup and said second coil of said dual coil neck flat humbucker pickup delivered to said output jack.

7. The pickup system according to claim 1 wherein:

said dual coil bridge flat humbucker pickup and said dual coil bridge stacked humbucker pickup are disposed on said guitar body under a first cover member to form a single bridge pickup unit; and, said dual coil neck flat humbucker pickup and said dual coil neck stacked humbucker pickup are disposed on said guitar body under a second cover member to form a neck pickup unit.

8. The pickup system according to claim 7 wherein each of said first and second cover members are about 1.5 inches by 2.5 inches in size.

9. A pickup system in an electric guitar of the type including a guitar body, an output jack, a fingerboard projecting from the body, a neck on the fingerboard, and a set of strings extending from the neck to a bridge on the body, the pickup system comprising:

a bridge pickup unit including a first flat humbucker pickup and for producing first tonalities and a first stacked humbucker pickup for producing second tonalities;

a neck pickup unit including a second flat humbucker pickup for producing said first tonalities and a second stacked humbucker pickup for producing said second tonalities; and, switch means for connecting said first flat humbucker pickup, said first stacked humbucker pickup, said second flat humbucker pickup and said second stacked humbucker pickup in a plurality of selected combinations to said output jack to thereby enable the guitar to selectively produce said first tonalities, said second tonalities, and a blend of said first and second tonalities.

10. The pickup system according to claim 9 wherein:

the first flat humbucker pickup and the first stacked humbucker pickup are disposed under a first cover member; and, the second flat humbucker pickup and the second stacked humbucker pickup are disposed under a second pickup cover member.

11. The pickup system according to claims 10 wherein the bridge pickup unit and the neck pickup unit are spaced apart on said guitar body to form a pick area under said set of strings to permit the guitar to be played without mechanical interference in said pick area.

12. The pickup system according to claim 11 wherein the switch means includes at least one multiple position primary tonality select switch adapted to connect, in each of said multiple positions, the first and second flat humbucker pickups and the first and second stacked humbucker pickups to said output jack in corresponding multiple desired pickup coil combinations thereby selecting said first tonalities and said second tonalities to be produced by the guitar.

13. The pickup system according to claim 12 further including a second tonality select switch adapted to modify said connection of said first and second flat humbucker pickups and said first and second stacked humbucker pickups with said output jack to thereby select said blend of said first and second tonalities to be produced from said guitar.

14. The pickup system according to claim 12 wherein said primary tonality select switch is a six pole, five position switch.

15. The pickup system according to claim 9 wherein said bridge pickup unit and said neck pickup unit are unitary constructions and are disposed on said guitar body in a spaced apart relationship to form a pick area under said set of strings extending from the neck to the bridge.

16. The pickup system according to claim 15 wherein said bridge and neck pickup units are each about 1.5 inches by about 2.75 inches in size.

17. A pickup system for use in an electric guitar having an output jack and a set of strings extending over a pick area on a guitar body from a bridge area on the guitar body to a fingerboard neck adjacent to the body, the pickup system comprising:

a first combination treble and rhythm dual coil humbucker pickup pair disposed between the bridge area and the pick area;

a second combination treble and rhythm dual coil humbucker pickup pair disposed between the pick area and the fingerboard neck; and, a tonality select switch for selectively connecting the first combination treble and rhythm dual coil humbucker pickup pair with the second combination treble and rhythm dual coil humbucker pickup pair to said output jack in plurality of desired pickup combinations thereby selecting a plurality of desired tonality signals from said electric guitar.

18. The pickup system according to claim 17 wherein said first combination treble and rhythm dual coil humbucker pickup pair includes:

a dual bridge flat humbucker pickup; and, a dual coil bridge stacked humbucker pickup.

19. The pickup system according to claim 17 wherein said second combination treble and rhythm dual coil humbucker pickup pair includes:

a dual coil neck flat humbucker pickup; and, a dual coil neck stacked humbucker pickup.

20. The pickup system according to claim 17 wherein:

said first combination treble and rhythm dual coil humbucker pickup pair includes:

a dual coil bridge flat humbucker pickup; and, a dual coil bridge stacked humbucker pickup; and, said second combination treble and rhythm dual coil humbucker pickup pair includes:

a dual coil neck flat humbucker pickup; and, a dual coil neck stacked humbucker pickup.

21. The pickup system according to claim 20 wherein:

said dual coil bridge flat humbucker pickup is disposed between the bridge area and the pick area;

said dual coil bridge stacked humbucker pickup is disposed between the dual coil bridge flat humbucker pickup and the pick area;

said dual coil neck flat humbucker pickup is disposed between the pick area and the fingerboard neck; and, said dual coil neck stacked humbucker pickup is disposed between the dual coil neck flat humbucker pickup and the fingerboard neck.

22. The pickup system according to claim 21 wherein:

said dual coil bridge flat humbucker pickup and said dual coil bridge stacked humbucker pickup are disposed on said guitar body under a first cover member to form a single bridge pickup unit; and, said dual coil neck flat humbucker pickup and said dual coil neck stacked humbucker pickup are disposed on said guitar body under a second cover member to form a neck pickup unit.

23. The pickup system according to claim 22 wherein each of said first and second cover members are about 1.5 inches by 2.5 inches in size.

24. The pickup system according to claim 20 wherein the tonality select switch includes a five position switch adapted to:

when in a first position, connect the dual coil bridge and neck flat humbucker pickups with the dual coil bridge and neck stacked humbucker pickups to said output jack in a first desired pickup combination thereby selecting a first tonality signal from said electric guitar;

when in a second position, connect the dual coil bridge and neck flat humbucker pickups with the dual coil bridge and neck stacked humbucker pickups to said output jack in a third desired pickup combination thereby selecting a third tonality signal from said electric guitar;

when in a fourth position, connect the dual coil bridge and neck flat humbucker pickups with the dual coil bridge and neck stacked humbucker pickups in a fourth desired pickup combination thereby selecting a fourth tonality signal from said electric guitar; and, when in a fifth position, connect the dual coil bridge and neck flat humbucker pickups with said dual coil bridge and neck stacked humbucker pickups to said output jack in a fifth desired pickup combination thereby selecting a fifth tonality signal from said electric guitar.

25. The pickup system according to claim 24 wherein the tonality select switch includes at least one secondary tonality select switch adapted to:

selectively modify said first desired pickup combination thereby selecting a modified first tonality signal from said electric guitar;

selectively modify said second desired pickup combination thereby selecting a modified second tonality signal from said electric guitar;

selectively modify said third desired pickup combination thereby selecting a modified tonality signal from said electric guitar;

selectively modify said fourth desired pickup combination thereby selecting a modified fourth tonality signal from said electric guitar; and, selectively modify said fifth desired pickup combination thereby selecting a modified fifth tonality signal from said electric guitar.

26. The pickup system according to claim 25 wherein the secondary tonality select switch is adapted to:

selectively modify said first desired pickup combination thereby selecting a plurality of modified first tonality signals from said electric guitar;

selectively modify said second desired pickup combination thereby selecting a plurality of modified second tonality signals from said electric guitar;

selectively modify said third desired pickup combination thereby selecting a plurality of modified third tonality signals from said electric guitar;

selectively modify said fourth desired pickup combination thereby selecting a plurality of modified fourth tonality signals from said electric guitar; and, selectively modify said fifth desired pickup combination thereby selecting a plurality of modified fifth tonality signals form said electric guitar.

27. The pickup system according to claim 26 wherein:

the tonality select switch is a six pole, five position switch; and, the at least one secondary tonality select switch includes a pair of double pole, two position switches.

28. The pickup system according to claim 24 wherein:

said five position switch generates said first desired pickup combination as a series connection of said first coil of said dual coil bridge flat humbucker pickup and a second coil of said dual coil bridge flat humbucker pickup delivered to said output jack;

the five position switch generates said second desired pickup combination as a series connection of a first coil of said dual coil neck stacked humbucker pickup and a second coil of said dual coil neck stacked humbucker pickup in parallel with said first coil of said dual coil bridge flat humbucker pickup delivered to said output jack;

the five position switch generates said third desired pickup combination as a series connection of said first coil of said dual coil neck stacked humbucker pickup and said second coil of said dual coil neck stacked humbucker and said second coil of said dual coil neck stacked humbucker pickup in parallel with a series connection of a first coil of said dual coil neck flat humbucker pickup and a second coil of said dual coil neck flat humbucker pickup in parallel with a series connection of said first coil of said dual coil bridge flat humbucker pickup and said second coil of said dual coil bridge flat humbucker pickup delivered to said output jack;

the five position switch generates said fourth desired pickup combination as a series connection of said first coil of said dual coil neck stacked humbucker pickup and said second coil of said dual coil neck stacked humbucker pickup in parallel with a series connection of a first coil of said dual coil bridge stacked humbucker pickup and a second coil of said dual coil bridge stacked humbucker pickup in parallel with said second coil of said dual coil neck flat humbucker pickup delivered to said output jack; and, the five position switch generates said fifth desired combination as a series connection of said first coil of said dual coil neck flat humbucker pickup and said second coil of said dual coil neck flat humbucker pickup delivered to said output jack.

29. The pickup system according to claim 27 wherein:

said dual coil bridge flat humbucker pickup and said dual coil bridge stacked humbucker pickup are disposed on said guitar body under a first cover member to form a single bridge pickup unit; and, said dual coil neck flat humbucker pickup and said dual coil neck stacked humbucker pickup are disposed on said guitar body under a second cover member to form a neck pickup unit.

30. The pickup system according to claim 29 wherein each of said first and second cover members are about 1.5 inches by 2.5 inches in size.

* * * * *